United States Patent [19]

Nunez Fuentes

[11] 4,070,918

[45] Jan. 31, 1978

[54] GRIPPER HOLDER BANDS DRIVING MECHANISM FOR SHUTTLELESS LOOMS

[75] Inventor: Cayetano Nunez Fuentes, Sabadell, Spain

[73] Assignee: Ingeniera Aplicada, S.A. (INAPSA), Badalona, Spain

[21] Appl. No.: 583,973

[22] Filed: June 5, 1975

[30] Foreign Application Priority Data

June 6, 1974 Spain ..... 203730

[51] Int. Cl.[2] ..... F16H 21/40

[52] U.S. Cl. ..... 74/70; 139/449

[58] Field of Search ..... 74/70; 139/122, 127, 139/123

[56] References Cited

U.S. PATENT DOCUMENTS

| | | | |
|---|---|---|---|
| 3,192,958 | 7/1965 | Birmans et al. | 139/122 R |
| 3,678,968 | 7/1972 | Juillard | 139/127 R |

FOREIGN PATENT DOCUMENTS

| | | | |
|---|---|---|---|
| 962,226 | 4/1957 | Germany | 74/70 |

*Primary Examiner*—Samuel Scott

*Assistant Examiner*—Wesley S. Ratliff, Jr.

*Attorney, Agent, or Firm*—Toren, McGeady and Stanger

[57] ABSTRACT

A shuttleless loom including a pair of lance bands operative to insert weft threads through a shed of warp threads is constructed with a driving crankshaft which operates to synchronously drive both the lance bands and the reciprocating sley of the loom. A sector gear is mounted upon the sley for reciprocal pivotal movement whereby the lance bands are driven through a gear train meshing with the sector gear. The sector gear is driven through a connecting rod mounted eccentrically upon a drive wheel which is driven by the crankshaft. Because of the eccentric mounting of the connecting rod upon the crankshaft, the reciprocating pivotal motion of the sector gear imparts increased acceleration to the lance bands midway through their travel and a decreased acceleration at the ends of the lance band stroke. Furthermore, inasmuch as the sector gear is pivotally mounted upon the sley, reciprocal movement of the sley will cause a certain degree of sector gear rotation thereby imparting some degree of movement to the lance bands.

3 Claims, 2 Drawing Figures

GRIPPER HOLDER BANDS DRIVING MECHANISM FOR SHUTTLELESS LOOMS

The present invention refers to a synchronizing sley and lances drive mechanism for shuttleless looms of simply construction and highly efficient operation as it can split the motions of a single driving shaft.

Essentially, the mechanism is comprised by an assembly embodied by a handle and connection rod-crankshaft as a sley motion principle completed by another handle and connection rod-crankshaft synchronized with the previous one which rotates at double its speed resulting from the assembly a reciprocating motion which causes reciprocation of gripper holder bands inputs and outputs to each course or cycle of sley motion.

Fundamentally, the advantages of this embodiment are shown firstly by the position of the sley driving crankshaft which as arranged allows a multiple impulse of the sley or reed-holder arm, thus giving rise to a high rigidity not attainable through some arrangements and systems and secondly, that motion assembly of gripper holder bands due to their synchronism with the sley one attains significant advantages such as its easy and simple adjustment of gripper-holder band travel within the fabric as also the gripper-holder stoppage so that an excessive travel is avoided during the non-active rotation sector which consequently might cause an excessive approach to the loom.

For a better understanding of the nature of the present invention the following drawings are attached, wherein.

Figure 1:
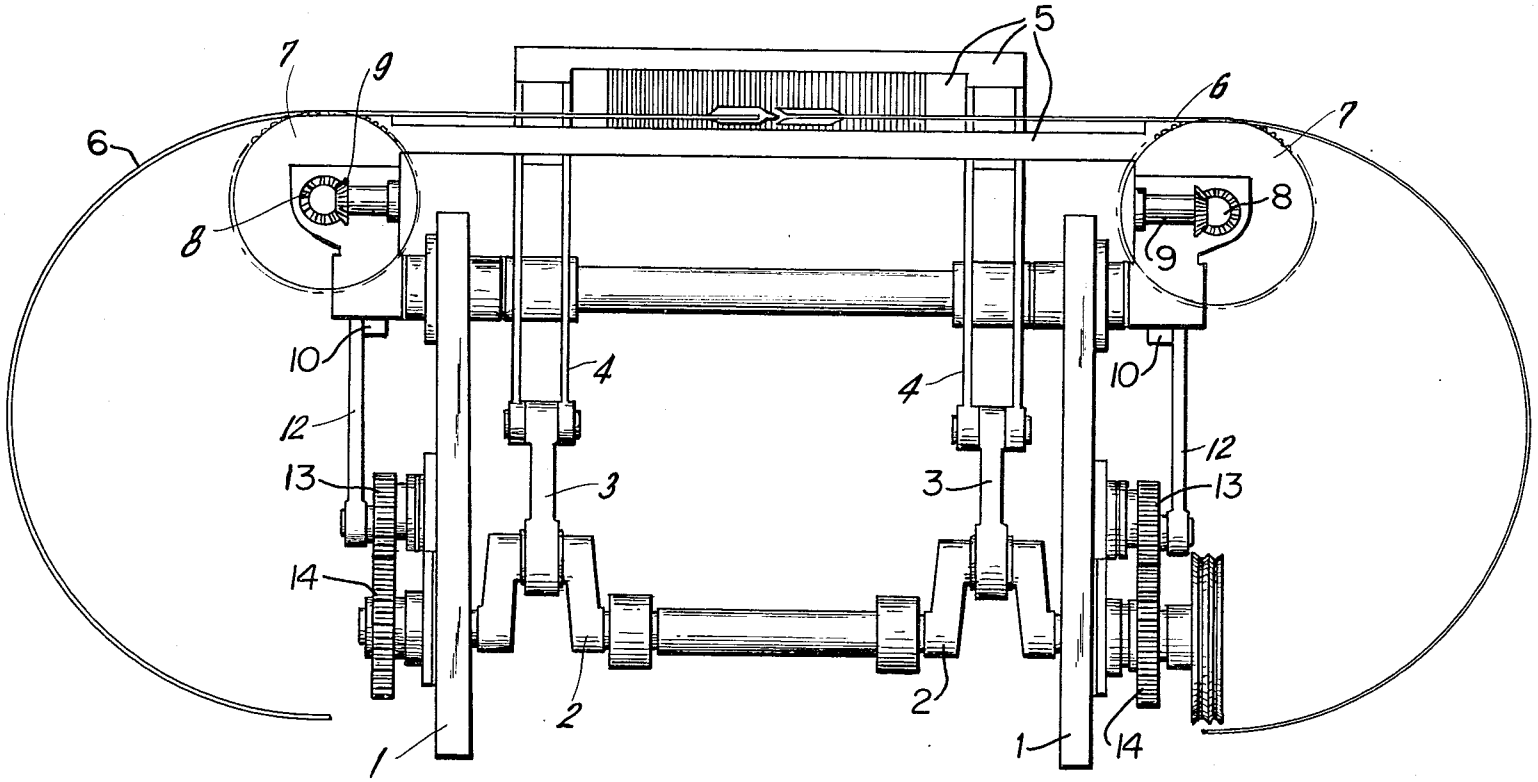
FIG. 1 is frontal elevation diagrammatically view of said mechanism.
Figure 2:
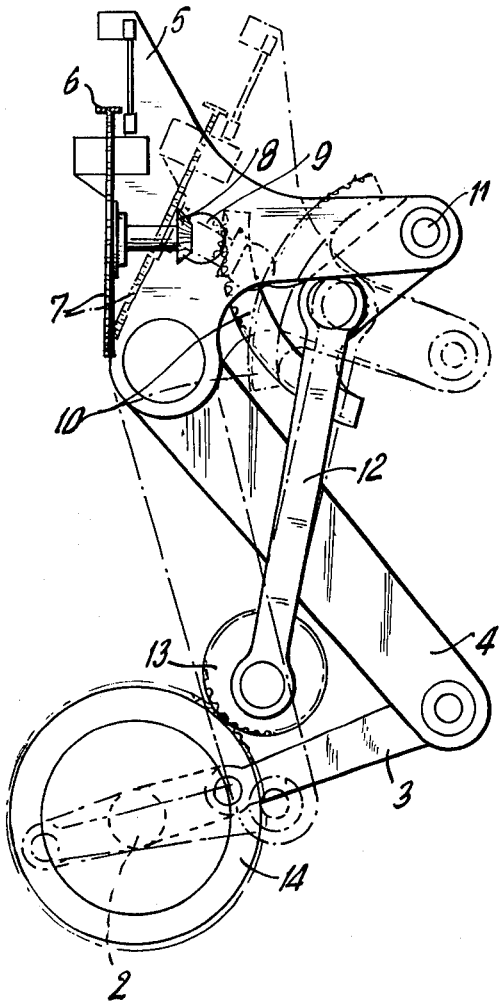
FIG. 2 is a profile view of said mechanism showing with a dot-dash line the sley collection position and conversely, when bands are in operation i.e. which traverse the yarn becoming the fabric weft.

On these figures the following components are shown:

1.— Bedplate
2.— Crankshaft
3.— Connection Rod
4.— Sley Arms
5.— Sley
6.— Lance band
7.— Toothed Flywheel
8.— Taper pinion
9.— Gears
10.— Toothed Sector
11.— Toothed Sector Rotation Shaft (10)
12.— Connection Rod
13.— Driving wheel of connection rod eccentricity 12.
14.— Drive wheel associated to crankshaft 2.

According to such figures and components, the sley and lance driving arrangement for shuttleless looms, object of the present invention is comprised by a crankshaft 2, which currently is fitted with two crankpins located at opposite ends of loom but through their arrangement can be limitless extended, in accordance to requirements caused by the width or provisions of a higher impulse rigidity carrying over their motion to sley or reed-holder arm 4 through pertinent connection rods 3. Linking the sley 5 arms is found a sliding base of the gripper-holder band 6 wherein is fitted additionally a slot for reed anchoring and positioning which function is to guide the warp and sleying the weft course to course; such sliding base is extended to outside of loom by both sides until is linked to some holding mechanism assembly of reciprocating motion of gripper-holder band 6 and lance and swinging during motion with the own reed-holder arm or sley 5 and within its own center.

At the ends of crankshaft 2 a pair of gears 14 are arranged which drive the pin-holder plates 13 such as their angular speed becomes double that of crankshaft speed 2. On said pins the connection rods 12 are pivotally connected to a toothed sector 10 through an adjustable pin so that the width of the toothed sector swing 10 can be increased or decreased; said toothed sector 10 swings on the own sley 5 and carries over its motion to the gear 9 which in turn carries the motion over to the taper pinion 8 associated to the toothed flywheel 7 a carrier of the motion to the weft holding and collecting band.

Motion synchronization is obtained by the required gears 13 and 14 coupling to accomplish the dead center condition in the lance travel beyond the matching fabric with the sleying action. By the way it must be noted that the connection rod 12 is pivoted on two slidable trunnions thereby what is turned out i.e. acceleration and deceleration in the rotation of the toothed sector 10 will be composite i.e. that at the times of lance collecting the yarn going to become a weft i.e. at the beginning of its travel as also at the end, which is in the center of the loom whereto said yarn is to be transmitted between the ends of said lance, these steps are to be performed as slowly as possible, which is attained with this synchronism and conversely at the intermediate points of said travel the acceleration will be higher. This is explained because when the sector 10 is pivoted to the sley 5 rear side and linked to the connection rod 12 we have that whenever said sley is swinged the sector undergoes an alteration with respect to the sley, such alteration is uniform i.e. has an identical motion to that of the sley, however since the connection rod 12 is fitted on an eccentric trunnion in the wheel 13 a composite motion is given with accelerations and decelrations which will favour the transmission and trapping of the yarn to become a weft, thus avoiding breakages, etc.

Adjustment of plate 13 eccentricity allows a length adjustment such as to obtain accelerations and decelrations suitable for each case; whereas connection rod 12 anchoring adjustment in its attachment with the toothed sector 10 allows an adjustment of a band higher or lower travel.

Significantly noted is that said adjustment by its own construction arrangement has the feature that the whole of the variation of the experienced travel being either one or any other selected anchoring point, variation of sector initial position 10 is taken up and thereby of the band 6 but to keep always fixed the travel final position is essential due to the matching requirement of both bands 6 in the center of the fabric, position where the weft-to be yarn transfer is turned out.

Consequently, this adjustment would be performed according to the width of the fabric to be manufactured choosing for each width a pivoting point suitable so that the band 6 initial position is near the fabric selvedge thereby beginning to drive out the weft when its travel begins and thus at low speed.

As the band or lance motion cycle is constant, being either higher or lower the travel also the motion linear speed will be higher or lower, thus giving off that for an identical band or lance linear speed the assembly angular speed can be altered such that for the same active width of the machine its production speed is inversely proportional to the fabric width being manufactured.

I claim:

1. A shuttleless loom having means forming a shed of warp threads including a sley mounted for reciprocal movement, weft insertion means including a pair of lance bands reciprocal toward and away from each other through said shed and a driving mechanism for synchronously driving said sley and said lance bands, said driving mechanism comprising a driving crankshaft, crank means driven by said crankshaft for imparting reciprocal movement to said sley, gear train means including sector gear means pivotally mounted upon said sley for reciprocally driving said lance bands, transmission means including drive wheel means for transmitting power from said crankshaft to said sector gear means, connecting rod means operatively interconnected between said drive wheel means and said sector gear means for effecting reciprocal pivotal motion of said sector gear means and adjustment eccentrically mounting said connecting rod means upon said drive wheel means operative to enable readjustment of the eccentricity of said connecting rod means relative to said drive wheel means, said transmission means being structured to impart to said drive wheel means two revolutions for each single revolution of said crankshaft, with readjustment of the eccentricity of said connecting rod means relative to said drive wheel means operating to effect variation of the operating stroke of said lance bands.

2. A loom according to claim 1 wherein reciprocal movement of said sley imparts pivotal movement to said sector gear means thereby imparting a consequent degree of motive force to said lance bands through said gear train means.

3. A loom according to claim 1, wherein due to the eccentric mounting of said connecting rod means upon said drive wheel means, the reciprocal movement imparted to said lance bands by said sector gear means causes a decrease in acceleration at the start and finish of the operating stroke of said lance bands and an increased acceleration midway of the stroke of said lance bands.

* * * * *